US007030833B2

(12) United States Patent
Ohara et al.

(10) Patent No.: US 7,030,833 B2
(45) Date of Patent: Apr. 18, 2006

(54) ANTENNA DEVICE

(75) Inventors: Katsuhiro Ohara, Obu (JP); Toru Yamazaki, Chita (JP); Seishin Mikami, Toyota (JP)

(73) Assignee: DENSO Corporation, Kariya (JP)

( * ) Notice: Subject to any disclaimer, the term of this patent is extended or adjusted under 35 U.S.C. 154(b) by 29 days.

(21) Appl. No.: 10/936,001

(22) Filed: Sep. 8, 2004

(65) Prior Publication Data

US 2005/0057406 A1 Mar. 17, 2005

(30) Foreign Application Priority Data

Sep. 16, 2003 (JP) ..... 2003-322938

(51) Int. Cl.
*H01Q 21/00* (2006.01)

(52) U.S. Cl. ..... 343/867; 343/742; 343/702

(58) Field of Classification Search ..... 343/702, 343/741, 742, 866, 867
See application file for complete search history.

(56) References Cited

U.S. PATENT DOCUMENTS 5,583,523 A * 12/1996 Wallace, Jr. ..... 343/741
5,847,683 A * 12/1998 Wolfe et al. ..... 343/866
6,680,708 B1 * 1/2004 Yamaki ..... 343/741

FOREIGN PATENT DOCUMENTS

JP 2002-290138 10/2002

* cited by examiner

*Primary Examiner*—Hoang V. Nguyen
(74) *Attorney, Agent, or Firm*—Harness, Dickey & Pierce, PLC

(57) ABSTRACT

An antenna device includes a ground plane, a first radiation element, and a second radiation element that is entirely disposed within the first radiation element. Of the first radiation element, a portion from a first end portion to a first bending portion electromagnetically couples with, of the second radiation element, a portion from a first end portion to a first bending portion. Further, of the first radiation element, a portion from a second end portion to a second bending portion electromagnetically couples with, of the second radiation element, a portion from a second end portion to a second bending portion. This structure enables the second radiation element to be resonant with the first radiation element.

15 Claims, 8 Drawing Sheets

FIG. 4

| | 800MHz BAND DIRECTION | 1.9GHz BAND DIRECTION | 2.1GHz BAND DIRECTION | VERTICAL AV. GAIN [dBi] | HORIZONTAL AV. GAIN [dBi] |
|---|---|---|---|---|---|
| 800MHz BAND PERFORMANCE | P | — | — | -3.8 | -3.6 |
| | P | P | — | -3.8 | -3.6 |
| | P | P | P | -3.7 | -3.7 |
| | P | N | — | -3.9 | -4.1 |
| | P | N | N | -1.8 | -2.7 |
| | P | N | P | -2.3 | -3.5 |
| 1.9GHz BAND PERFORMANCE | P | — | — | — | — |
| | P | P | — | -6.5 | -4.6 |
| | P | P | P | -6.7 | -5.2 |
| | P | N | — | -2.4 | -6.2 |
| | P | N | N | -4.2 | -4.9 |
| | P | N | P | -3.1 | -5.3 |
| 2.1GHz BAND PERFORMANCE | P | — | — | — | — |
| | P | P | — | — | — |
| | P | P | P | -8.3 | -5.2 |
| | P | N | — | — | — |
| | P | N | N | -4.8 | -6.4 |
| | P | N | P | -4.1 | -6.8 |

P : POSITIVE
N : NEGATIVE

ANTENNA DEVICE

CROSS REFERENCE TO RELATED APPLICATIONS

This application is based on and incorporates herein by reference Japanese Patent Application No. 2003-322938 filed on Sep. 16, 2003.

FIELD OF THE INVENTION

The present invention relates to an antenna device that is used in mobile communications devices and formed of multiple radiation elements earthed to a ground plane.

BACKGROUND OF THE INVENTION

JP-2002-290138 A describes an antenna device formed of multiple radiation elements that are earthed to the ground plane. This antenna device includes a first radiation element and a second radiation element. Each of the two radiation elements includes a turnup portion so that two side portions are formed in approximately parallel with each other. Further, each of the two radiation elements includes a bending portion so that the two side portions are formed in approximately parallel with a ground plane. Further, the two radiation elements adjoin approximately parallel with each other while being grounded to the ground plane.

In this antenna device, the entire second radiation element is disposed separately outside the first radiation element, so that achievement of multiple-frequency resonance requires widths of the radiation elements and an interval gap between the radiation elements. The antenna device thereby becomes large-sized.

SUMMARY OF THE INVENTION

It is an object of the present invention to provide an antenna device capable of properly achieving multiple-frequency resonance without its size becoming large-sized.

To achieve the above object, an antenna device is provided with the following. A ground plane, a first radiation element formed of a transmission line antenna, and a second radiation element formed of transmission line antenna are provided. Each of the transmission line antennas includes a first end portion and a second end portion that are approximately perpendicular to the ground plane; a first bending portion and a second bending portion; a first side portion and a second side portion that are linked with the first bending portion and the second bending portion, respectively; and a turnup portion that is formed between the first side portion and the second side portion. The first side portion and the second side portion are approximately parallel with the ground plane and approximately parallel with each other. In the first radiation element, the first end portion functions as a current feeding point, while the second end portion is electrically connected to the ground plane. In the second radiation element, the first end portion and the second end portion are electrically connected to the ground plane. Here, at least a part of the second radiation element is disposed within the first radiation element. A first portion from the first end portion of the first radiation element to the first bending portion of the first radiation element is disposed with a first gap in approximately parallel with a first portion from the first end portion of the second radiation element to the first bending portion of the second radiation element. A second portion from the second end portion of the first radiation element to the second bending portion of the first radiation element is disposed with a second gap in approximately parallel with a second portion from the second end portion of the second radiation element to the second bending portion of the second radiation element.

This structure is different from a conventional structure where the second radiation element is entirely disposed outside the first radiation element. Since, in this structure, at least a part of the second radiation element is disposed within the first radiation element, the entire antenna device is prevented from becoming large-sized. Further, in this structure, portions from the end portions to the adjoining bending portions (hereunder referred to "leg portion") are disposed with given gaps in parallel with their corresponding portions, respectively. Namely, the first leg portions of the first and second radiation elements are parallel with each other with the first gap, while the second leg portions of the first and second radiation elements are parallel with each other with the second gap. Therefore, the first leg portion of the first radiation element that is perpendicular to the ground plane and has a strong magnetic field electromagnetically couples with the first leg portion of the second radiation element. Further, the second leg portion of the first radiation element that is perpendicular to the ground plane and has a strong magnetic field electromagnetically couples with the second leg portion of the second radiation element. The second radiation element thereby becomes resonant with the first radiation element. A multiple-frequency (two-frequency) resonance can be properly achieved. Here, the entire lengths of the first and second radiation elements are formed to be one-second (½) of the wave lengths of the corresponding communicating radio frequencies. The second radiation element has a shorter length than the first radiation element, so that the second radiation element corresponds to a higher frequency than the first radiation element.

In another aspect of the present invention, an antenna device is provided with the following. A second radiation element is formed of a reverse-L shaped antenna while the first radiation antenna is the same transmission line antenna as the foregoing. The reverse-L shaped antenna includes a first end portion that is electrically connected to the ground plane; a second end portion; and a bending portion. Here, at least a part of the second radiation element is disposed within the first radiation element. A first portion from the first end portion of the first radiation element to the first bending portion of the first radiation element or a second portion from the second end portion of the first radiation element to the second bending portion of the first radiation element is disposed with a gap in approximately parallel with a portion from the first end portion of the second radiation element to the bending portion of the second radiation element.

This structure also exhibits the same effects such as preventing the antenna device from becoming large, and achieving multiple-frequency resonance. However, in this aspect, the entire length of the first radiation element is formed to be one-second (½) of the wave length of the corresponding communicating radio frequency, while the entire length of the second radiation element is formed to be one-fourth (¼) of the wave length of the corresponding communicating radio frequency. The second radiation element has a shorter length than the first radiation element, so that the second radiation element corresponds to a higher frequency than the first radiation element.

BRIEF DESCRIPTION OF THE DRAWINGS

The above and other objects, features, and advantages of the present invention will become more apparent from the following detailed description made with reference to the accompanying drawings. In the drawings:

FIG. 4 is a table showing measurement results of gains of each of radiation elements;

DETAILED DESCRIPTION OF THE PREFERRED EMBODIMENTS (First Embodiment)

Figure 1:
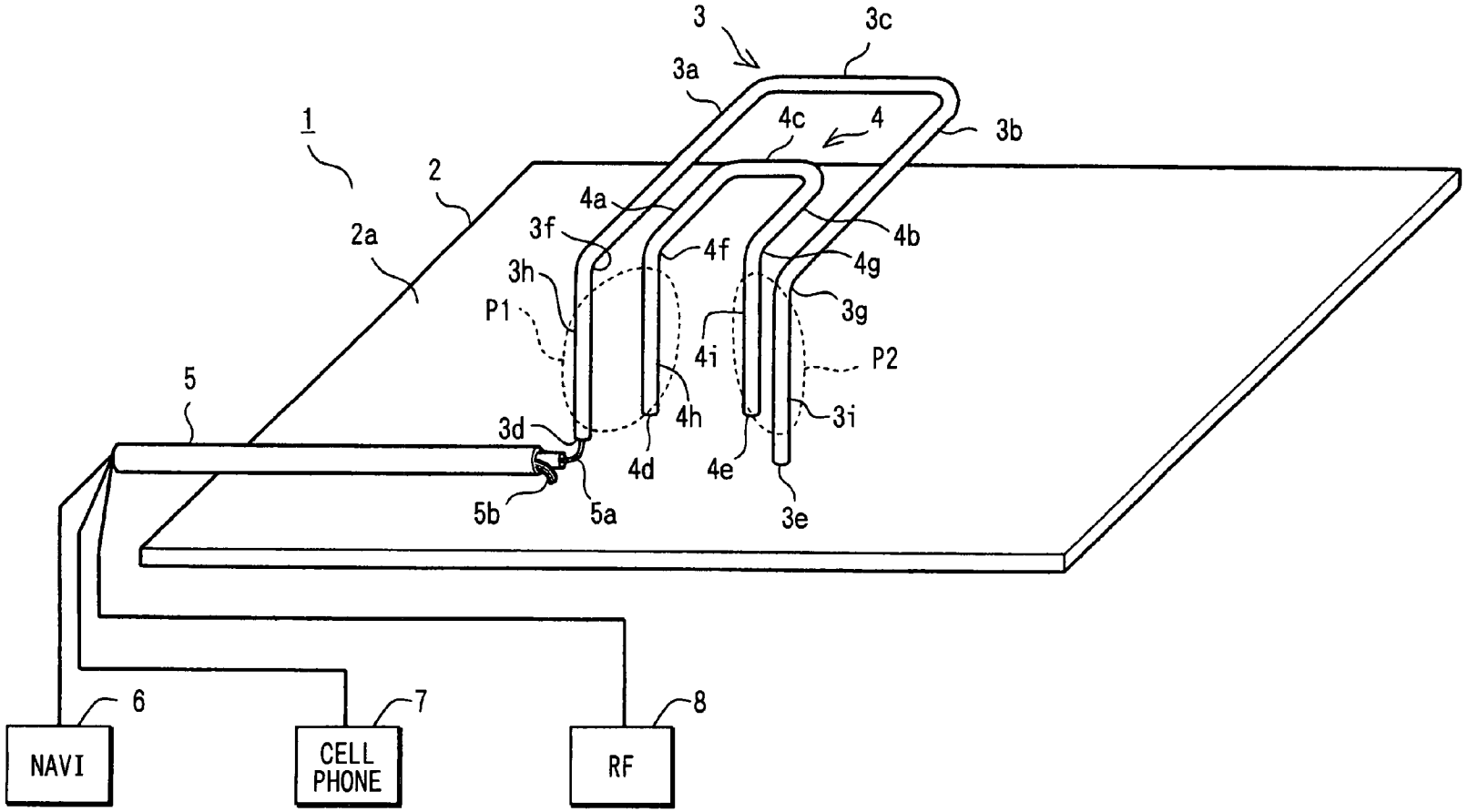
FIG. 1 is a schematic view of an antenna device according to a first embodiment of the present invention.

An antenna device 1 according to a first embodiment will be explained with reference to FIG. 1. The antenna device 1 is formed of a ground plane 2, a first radiation element 3, and a second radiation element 4. The ground plane 2 is formed of a metal plate whose planar dimension is much larger than those of the first and second radiation elements 3, 4.

The first radiation element 3 is formed of a transmission line antenna, where a turnup portion 3*c* is formed in such a manner that two side portions 3*a*, 3*b* are disposed approximately parallel with each other, and a first and second end portions 3*d*, 3*e* are disposed approximately perpendicular to the surface 2*a* (upper surface in FIG. 1) of the ground plane 2. The first end portion 3*d* functions as a current feeding point, while the second end portion 3*e* is electrically connected to the ground plane 2. The two bending portions 3*f*, 3*g* are formed in such a manner that the two side portions 3*a*, 3*b* are disposed approximately parallel with the ground plane 2. Here, first and second leg portions 3*h*, 3*i* are defined to be from the first and second end portions 3*d*, 3*e* to the first and second bending portions 3*f*, 3*g*, respectively. Further, the first and second leg portions 3*h*, 3*i* of the first radiation element 3 have the same lengths.

The first radiation element 3 has an entire length from the first end portion 3*d* to the second end portion 3*e*, the entire length which is one-second (½) of a wave length of an "800 MHz" frequency band. Further, the first radiation element 3 has the bending portions 3*f*, 3*g*, so that a short height structure is achieved.

The second radiation element 4 is formed of a transmission line antenna, where a turnup portion 4*c* is formed in such a manner that two side portions 4*a*, 4*b* are disposed approximately parallel with each other, and a first and second end portions 4*d*, 4*e* are disposed approximately perpendicular to the surface 2*a* of the ground plane 2. The first end portion 4*d* and second end portion 4*e* are electrically connected to the ground plane 2. The two bending portions 4*f*, 4*g* are formed in such a manner that the two side portions 4*a*, 4*b* are disposed approximately parallel with the ground plane 2. Here, first and second leg portions 4*h*, 4*i* are defined to be from the first and second end portions 4*d*, 4*e* to the first and second bending portions 4*f*, 4*g*, respectively. Further, the first and second leg portions 4*h*, 4*i* of the second radiation element 4 have the same lengths.

The second radiation element 4 has a certain entire length from the first end portion 4*d* to the second end portion 4*e*, the certain entire length which is one-second (½) of a wave length of a "1.9 GHz" frequency band. Further, the second radiation element 4 has the bending portions 4*f*, 4*g*, so that a short height structure is achieved similarly with the first radiation element 3.

The second radiation element 4 is disposed entirely within the first radiation element 3. In other words, the entire second radiation element 4 is disposed within a virtual parallelepiped that is formed on the ground plane 2 by perpendicularly projecting the first radiation element 3 on the ground plane 2 while the first radiation element 3 itself being included as a part of an outer periphery of the virtual parallelepiped.

In detail, a height of the first radiation element 3 is approximately same as that of the second radiation element 4. Here, the height of the first radiation element 3, or the height of the above-described virtual parallelepiped means the length of the first or second leg portion 3*h*, 3*i* of the first radiation element 3, while the height of the second radiation element 4 means the length of the first or second leg portion 4*h*, 4*i* of the second radiation element 4. The first and second end portions 4*d*, 4*e* of the second radiation element 4 are disposed within an area from the line between the first and second end portions 3*d*, 3*e* towards the turnup portion 3*c*, i.e, within a rectangular area that is formed on the ground plane 2 by perpendicularly projecting the side portions 3*a*, 3*b*, and the turnup portion 3*c* on the ground plane 2. Directions of the side portions 4*a*, 4*b* from the bending portions 4*f*, 4*g* towards the turnup portion 4*c* of the second radiating element 4 are same as directions of the side portions 3*a*, 3*b* from the bending portions 3*f*, 3*g* towards the turnup portion 3*c* of the first radiation element 3.

Further, the first leg portion 3*h* of the first radiation element 3 is disposed with a first gap in approximately parallel with the first leg portion 4*h* of the second radiation element 4. The second leg portion 3*i* of the first radiation element 3 is disposed with a second gap in approximately parallel with the second leg portion 4*i* of the second radiation element 4. Here, the first gap and second gap have the approximately same dimensions.

The first end portion 3*d* is separated with a small gap from the ground plane 2. A coaxial cable 5 feeds current to the first radiation element 3. Of the cable 5, an internal conductor 5*a* is electrically connected with the first end portion 3*d* of the first radiation element 3. Of the cable 5, an external conductor 5*b* is electrically connected with the ground plane 2. The cable 5 is wired on the surface 2*a* of the ground plane 2 in such a manner that the cable 5 can avoid a space formed by the first radiation element 3 and the ground plane 2 and a space formed by the second radiation element 4 and the ground plane 2.

When the antenna device 1 is connected with a navigation device 6 via the cable 5, the antenna device 1 can function as an external antenna of the navigation device 6. When the antenna device 1 is connected with a cell phone 7 via the cable 5, the antenna device 1 can function as an external antenna of the cell phone 7. When the antenna device 1 is connected with an RF circuit 8 built in the navigation device or cell phone via the cable 5, the antenna device 1 can function as an internal antenna of the navigation device or the cell phone.

Next, functions of the above-described structure will be explained below. As explained above, the first leg portion 3*h* of the first radiation element 3 is disposed with the first gap in approximately parallel with the first leg portion 4*h* of the second radiation element 4. The second leg portion 3*i* of the first radiation element 3 is disposed with the second gap in approximately parallel with the second leg portion 4*i* of the second radiation element 4. Here, the first gap and second gap are approximately same. Therefore, when current is fed to the first radiation element 3 via the coaxial cable 5, the first leg portion 3*h* of the first radiation element 3 that is perpendicular to the ground plane 2 and has a strong magnetic field electromagnetically couples with the first leg portion 4*h* of the second radiation element 4 (see P1 in FIG. 1). Further, the second leg portion 3*i* of the first radiation element 3 that is perpendicular to the ground plane 2 and has a strong magnetic field electromagnetically couples with the second leg portion 4*i* of the second radiation element 4. The second radiation element 4 thereby becomes resonant with the first radiation element 3. This enables the antenna device 1 to radiate and receive radio waves of an "800 MHz" frequency band by the first radiation element 3 and also radio waves of a "1.9 GHz" frequency band by the second radiation element 4. Namely, a two-frequency resonance can be properly achieved. Here, the heights of the first and second radiation elements 3,4 are approximately same, so that efficiency of the two-frequency resonance by the first and second radiation elements 3,4 can be increased to the best. Further, the first gap and second gap are approximately same, so that the electromagnetic coupling generated between the first leg portion 3*h* and first leg portion 4*h* can be symmetrical with the electromagnetic coupling generated between the second leg portion 3*i* and second leg portion 4*i*. The two-frequency resonance by the first and second radiation elements 3, 4 can be thereby more effectively achieved.

Here, the second radiation element 4 can be disposed not only entirely but also partially within the first radiation element 3. In detail, as long as the second radiation element 4 is properly resonant with the first radiation element 3, the first and second end portions 4*d*, 4*e* can be outwardly disposed from the line between the first and second end portions 3*d*, 3*e* of the first radiation element 3 oppositely to the direction towards the turnup portion 3*c*. In other words, the first and second end portions 4*d*, 4*e* can be partially disposed outside the above-described virtual parallelepiped that includes the first radiation element 3 as the part of the outer periphery.

Further, the height of the second radiation element 4 can be shorter than that of the first radiation element 3.

Further, the first gap between the first leg portion 3*h* and the second leg portion 4*i* and the second gap between the first leg portion 3*i* and the second leg portion 4*i* can be different from each other. Here, the first gap or the second gap is determined in consideration of communications frequencies, the heights of the first and second radiation elements 3, 4, a positional relationship between the first and second radiation elements 3, 4, etc.

(Second Embodiment)

A second embodiment will be explained with reference to FIG. 2. The same part as the first embodiment will be eliminated and an only different part will be explained. In the first embodiment, the directions of the side portions 4*a*, 4*b* of the second radiation element 4 from the bending portions 4*f*, 4*g* towards the turnup portion 4*c* are the same as the directions of the side portions 3*a*, 3*b* of the first radiation element 3 from the bending portions 3*f*, 3*g* towards the turnup portion 3*c*. By contrast, in the second embodiment, the directions of the side portions 4*a*, 4*b* are opposite to the directions of the side portions 3*a*, 3*b*.

Figure 2:
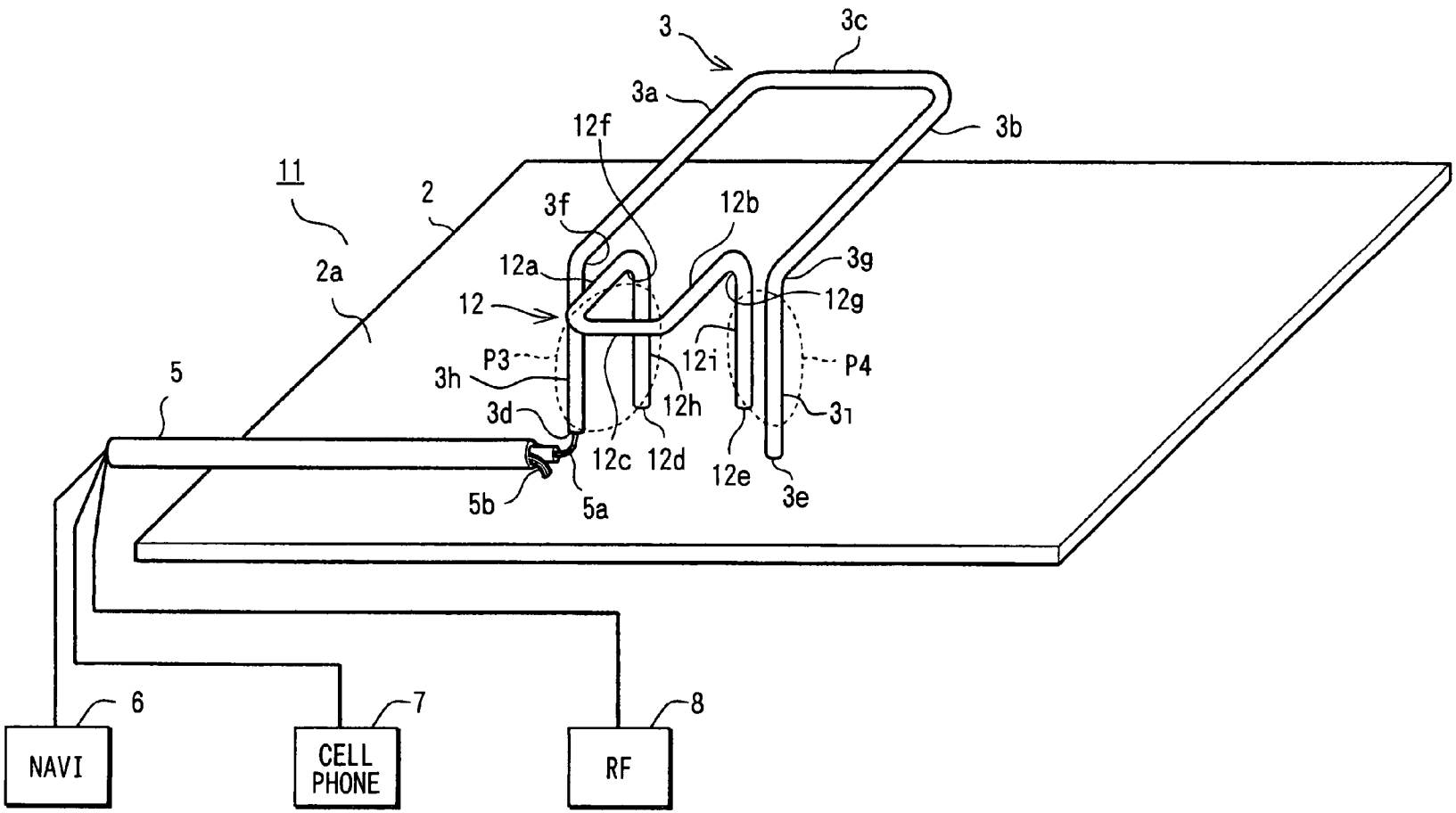
FIG. 2 is a schematic view of an antenna device according to a second embodiment of the present invention.

Namely, as shown in FIG. 2, in the antenna device 2, the second radiation element 12 is constructed to be similarly shaped with the second radiation element 4 of the first embodiment; however, the second radiation element 12 is only partially included within the first radiation element 3. In detail, of the second radiation element 12, the heights of the leg portions 12*h*, 12*i* are the approximately same as the heights of the leg portions 3*h*, 3*i* of the first radiation element 2. The first end portion 12*d* and second end portion 12*e* are disposed within an area from the line between the first and second end portions 3*d*, 3*e* towards the turnup portion 3*c*. However, differently from the first embodiment, a direction from the bending portions 12*f*, 12*g* towards the turnup portion 12*c* is opposite to a direction, of the first radiation element 3, from the bending portions 3*f*, 3*g* towards the turnup portion 3*c*. As explained above, in the second embodiment, in the antenna device 11, the second radiation element 12 is partially disposed within the first radiation element 3, so that the entire antenna device 11 can be prevented from becoming large.

Further, the first leg portion 12*h* of the second radiation element 12 is disposed with a first gap in approximately parallel with the first leg portion 3*h* of the first radiation element 3, while the second leg portion 12*i* of the second radiation element 12 is disposed with a second gap in approximately parallel with the second leg portion 3*i* of the first radiation element 3. Here, the first gap and second gap are approximately same. Therefore, the first leg portion 3*h* of the first radiation element 3 that is perpendicular to the ground plane 2 and has a strong magnetic field electromagnetically couples with the first leg portion 12*h* of the second radiation element 12 (see P3 in FIG. 2). Further, the second leg portion 3*i* of the first radiation element 3 that is perpendicular to the ground plane 2 and has a strong magnetic field electromagnetically couples with the second leg portion 12*i* of the second radiation element 12 (see P4 in FIG. 2). The second radiation element 12 thereby becomes resonant with the first radiation element 3. Namely, like the first embodiment, a two-frequency resonance can be properly achieved.

Further, since a direction from the bending portions 12*f*, 12*g* towards the turnup portion 12*c* is opposite to a direction, of the first radiation element 3, from the bending portions 3*f*, 3*g* towards the turnup portion 3*c*, differently from the first embodiment, the following effect can be achieved. Namely, an electromagnetic field generated from the first leg portion 3*h* of the first radiation element 3 less affects an electromagnetic field generated from the first leg portion 12*h* of the second radiation element 12; simultaneously, an electromagnetic field generated from the first leg portion 3*i* of the first radiation element 3 less affects an electromagnetic field generated from the first leg portion 12*i* of the second radiation element 12. As a result, the electromagnetic field generated from the second radiation element 12 can be prevented from being affected by the electromagnetic field generated from the first radiation element 3, so that a two-frequency resonance between the first and second radiation elements 3, 12 can be properly achieved.

(Third Embodiment)

Figure 5:
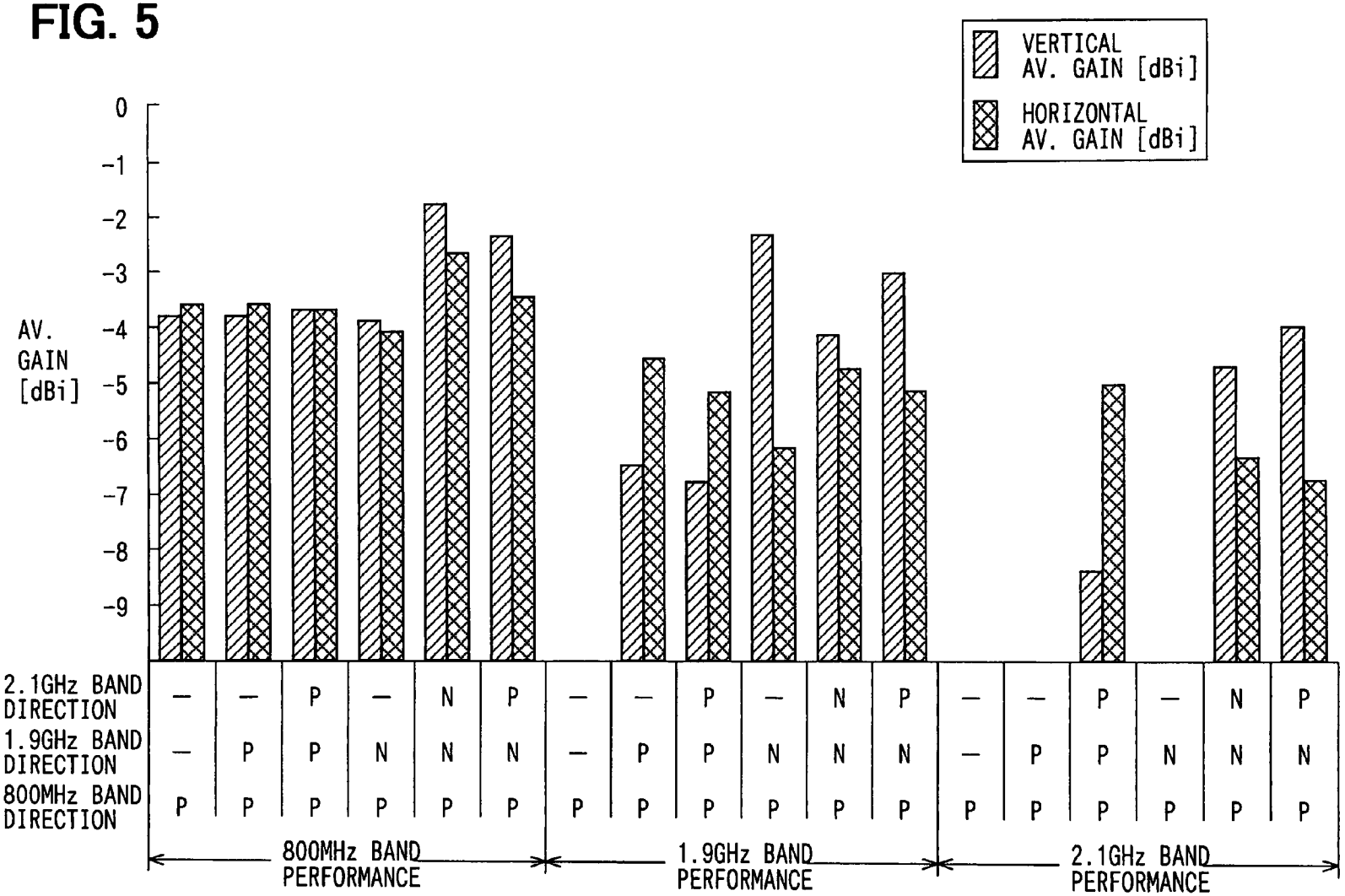
FIG. 5 is a graph showing measurement results of gains of each of radiation elements.

A third embodiment will be explained with reference to FIGS. 3 to 5. The same part as the second embodiment will be eliminated and an only different part will be explained. In the second embodiment, two of the first and second radiation elements 3, 12 are disposed; however, in the third embodiment, three of a first, second, and third radiation elements 3, 12, 22 are disposed on the ground plane 2.

Figure 3:
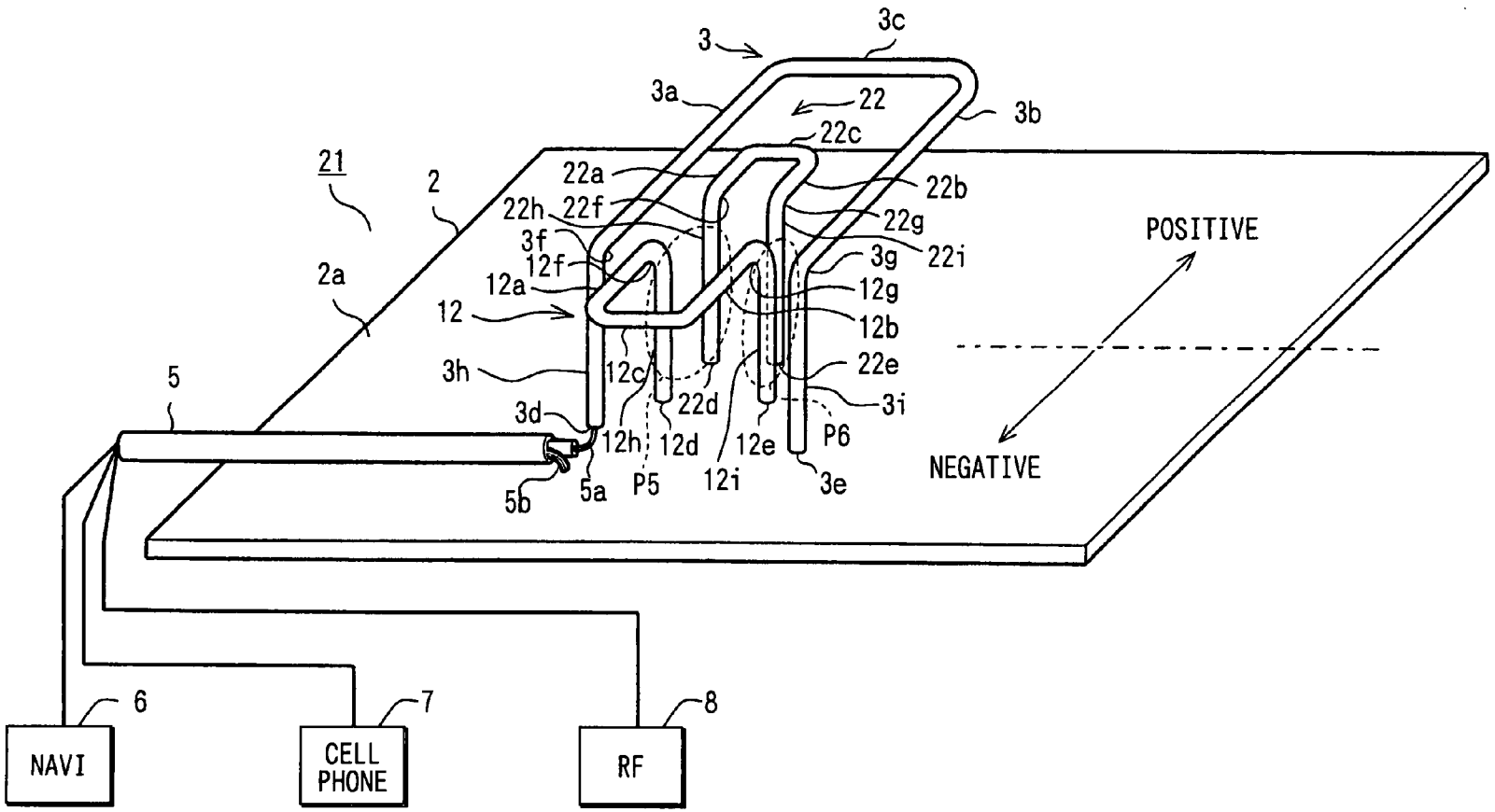
FIG. 3 is a schematic view of an antenna device according to a third embodiment of the present invention.

Namely, as shown in FIG. 3, in the antenna device 21, the third radiation element 22 is formed of a transmission line antenna, where a turnup portion 22*c* is formed in such a manner that two side portions 22*a*, 22*b* are disposed approximately parallel with each other, and a first and second end portions 22*d*, 22*e* are disposed approximately perpendicular to the surface 2*a* of the ground plane 2. The first end portion 22*d* and second end portion 22*e* are electrically connected to the ground plane 2. The two bending portions 22*f*, 22*g* are formed in such a manner that two side portions 22*a*, 22*b* are disposed approximately parallel with the ground plane 2. The third radiation element 22 has a certain entire length from the first end portion 22*d* to the second end portion 22*e*, the certain entire length which is one-second (½) of a wave length of a "2.1 GHz" frequency band.

Here, the third radiation element 22 is disposed entirely within the first radiation element 3. In detail, a height of the third radiation element 22 is approximately same as those of the first and second radiation elements 3, 12. Of the third radiation element 22, the first and second end portions 22*d*, 22*e* are disposed within an area from the line between the first and second end portions 12*d*, 12*e* of the second radiation element 12 towards the turnup portion 3*c* of the first radiation element 3. Further, the directions of the side portions 22*a*, 22*b* of the third radiation element 22 from the bending portions 22*f*, 22*g* towards the turnup portion 22*c* are the same as the directions of the side portions 3*a*, 3*b* of the first radiation element 3, from the bending portions 3*f*, 3*g* towards the turnup portion 3*c*, but opposite to the directions of the side portions 12*a*, 12*b* of the second radiation element 12, from the bending portions 12*f*, 12*g* towards the turnup portion 12*c*.

Further, a first leg portion 22*h* from the first end portion 22*d* of the third radiation element 22 to the first bending portion 22*f* of the third radiation element 22 is disposed with a first gap in approximately parallel with a first leg portion 12*h* of the second radiation element 12. A second leg portion 22*i* from the second end portion 22*e* of the third radiation element 22 to the second bending portion 22*g* of the third radiation element 22 is disposed with a second gap in approximately parallel with the second leg portion 12*i* of the second radiation element 12. Here, the first and second gaps are approximately same.

Here, when current is fed to the first radiation element 3 via the coaxial cable 5, the second radiation element 12 becomes resonant with the first radiation element 3. Simultaneously, the first leg portion 12*h* of the second radiation element 12 that is perpendicular to the ground plane 2 and has a strong magnetic field electromagnetically couples with the first leg portion 22*h* of the third radiation element 22 (see P5 in FIG. 3). Further, the second leg portion 12*i* of the second radiation element 12 that is perpendicular to the ground plane 2 and has a strong magnetic field electromagnetically couples with the third leg portion 22*i* of the third radiation element 22 (see P6 in FIG. 3). The third radiation element 22 thereby becomes resonant with the second radiation element 12. This enables the antenna device 21 to properly radiate and receive radio waves of an "800 MHz" frequency band by the first radiation element 3, radio waves of a "1.9 GHz" frequency band by the second radiation element 12, and radio waves of a "2.1 GHz" frequency band by the third radiation element 22. Namely, while the second radiation element 12 is resonant with the first radiation element 3, the third radiation element 22 is resonant with the second radiation element 12. A three-frequency resonance can be thereby properly achieved.

Incidentally, the inventors measured effects on performance generated by a combination of the mutual directions (of a side portion from a bending portion towards a turnup portion) of the radiation elements 3, 12, 22 that are disposed on the ground plane 2. The results of measurement are shown in a table in FIG. 4, while they are shown in a graph in FIG. 5. Here, the first radiation element 3 corresponds to an "800 MHz" frequency band; the second radiation element 12 corresponds to a "1.9 GHz" frequency band; and the third radiation element 22 corresponds to a "2.1 GHz" frequency band.

Here, the effects are studied mainly based on an average gain of vertical polarized wave constituent that is a strong electromagnetic field constituent in a practical environment where a cell phone antenna is adopted. For instance, in a positional structure shown in FIG. 3 (the third embodiment), the first and second radiation elements 3, 12 have the opposite positional directions (positive in the first radiation element, negative in the second), while the first and third radiation elements have the same positional directions. This positional structure exhibits, as the vertical polarized wave average gain, "−2.3 dBi" in the first radiation element 3, "−3.1 dBi" in the second radiation element, and "−4.1 dBi" in the third radiation element 22, so that it means that a given level of the vertical polarized wave gain can be obtained in all the radiation elements 3, 12, 22.

(Fourth Embodiment)

A fourth embodiment will be explained with reference to FIG. 6. The same part as the first embodiment will be eliminated and an only different part will be explained. In the first embodiment, the second radiation element 4 is formed of the transmission line antenna having the turnup portion 4*c*. By contrast, in the fourth embodiment, a second radiation element 32 is formed of a reverse-L shaped antenna.

Figure 6:
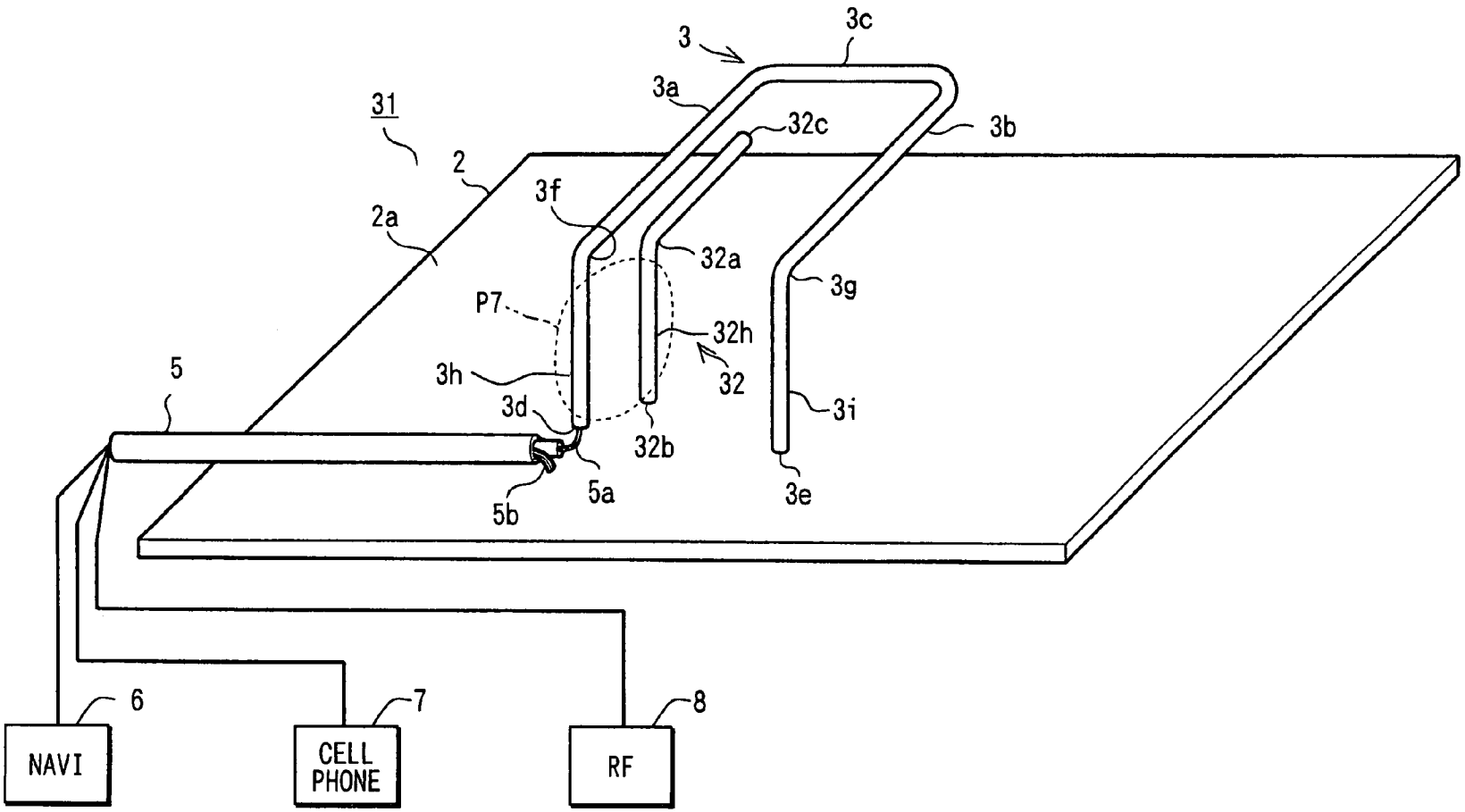
FIG. 6 is a schematic view of an antenna device according to a fourth embodiment of the present invention.

Namely, as shown in FIG. 6, in the antenna device 31, of the second radiation element 32, the reverse-L shaped antenna includes a bending portion 32*a*, a first end portion 32*b* electrically connected to the ground plane 2, and a second end portion 32*c*. A leg portion 32*h* is defined to be between the first end portion 32*b* and the bending portion 32*a*. The entire length of the second radiation element 32 from the first end portion 32*b* to the second end portion 32*c* is one-fourth (¼) of a wave length of, for instance, a "1.9 GHz" frequency band.

Here, the second radiation element 32 is disposed entirely within the first radiation element 3. In detail, a height of the second radiation element 32 (a length of the leg portion 32*h*) is the approximately same as that of the first radiation element 3. The first end portion 32*b* is disposed within an area from the line between the first and second end portions 3*d*, 3*e* towards the turnup portion 3*c*; and a direction from the bending portion 32*a* towards the second end portion 32*c* is the same as directions of the side portions 3*a*, 3*b* of the first radiation element 3 from the bending portions 3*f*, 3*g* towards the turnup portion 3*c* of the first radiation element 3. Here, the second radiation element 32 is disposed entirely within the first radiation element 3. This structure prevents the antenna device 31 from becoming large-sized.

Further, the first leg portion 3*h* of the first radiation element 3 is disposed with a gap in approximately parallel with the leg portion 32*h* of the second radiation element 32. Therefore, the first leg portion 3*h* of the first radiation element 3 that is perpendicular to the ground plane 2 and has a strong magnetic field electromagnetically couples with the leg portion 32*h* of the second radiation element 32 (see P7 in FIG. 6). The second radiation element 32 thereby becomes resonant with the first radiation element 3. This enables the antenna device 31 to properly achieve a two-frequency resonance.

(Other Embodiments)

The present invention can be modified or expanded without being limited to the above-described embodiments.

In the first embodiment, a third radiation element having a reverse-L shaped antenna can be combined. Namely, when three radiation elements are disposed on the ground plane, a direction from a bending portion to a second end portion of the third radiation element can be the same as the directions from the bending portions 3*f*, 3*g*, 4*f*, 4*g* towards the turnup portions of the first and second radiation elements 3, 4, respectively.

In the fourth embodiment shown in FIG. 6, the electromagnetic coupling can be generated to thereby achieve resonance between the second leg portion 3*i* of the first radiation element 3 and the leg portion 32*h* of the second radiation element 32 by disposing the leg portion 32*h* of the second radiation element 32 close to the second leg portion 3*i* of the first radiation element 3.

Figure 7:
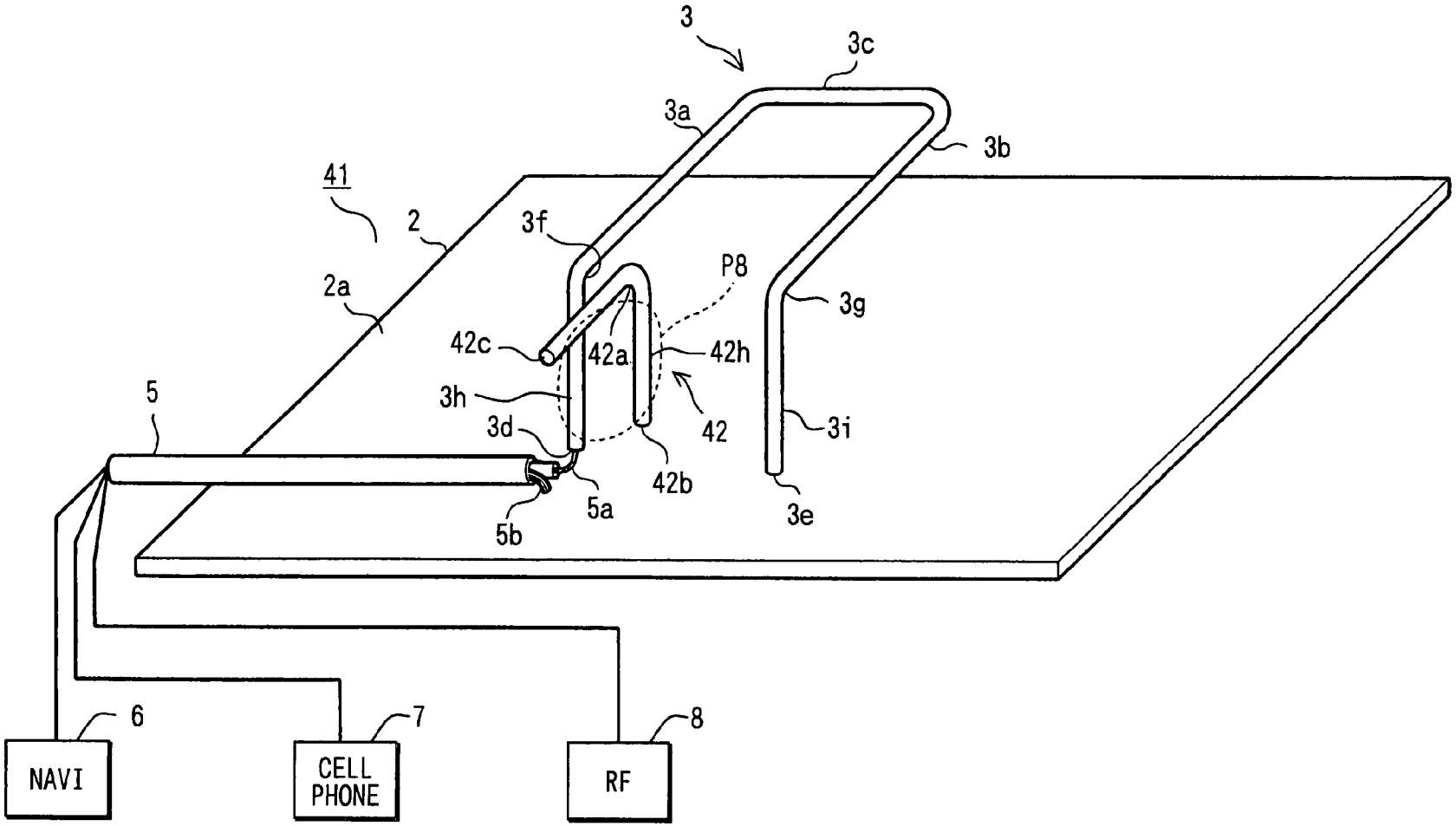
FIG. 7 is a schematic view of an antenna device according to another embodiment of the present invention.

In a structure where a first radiation element is formed of a transmission line antenna and a second radiation element is formed of a reverse-L shaped antenna, a technology explained in the second embodiment can be adopted. Namely, as shown in FIG. 7, in the antenna 41, the directions of the side portions 3*a*, 3*b* of the first radiation element 3 from first bending portions 3*f*, 3*g* towards a turnup portion 3*c* are opposite to a direction from a bending portion 42*a* to a second end portion 42*c*. Here, by disposing the second radiation element 42 close to the first leg portion 3*h*, electromagnetic coupling is generated between the first leg portion 3*h* and a leg portion 42*h* from the first end portion 42*b* to the bending portion 42*a* (P8 in FIG. 7). The second radiation element 42 is thereby resonant with the first radiation element 3.

Figure 8:
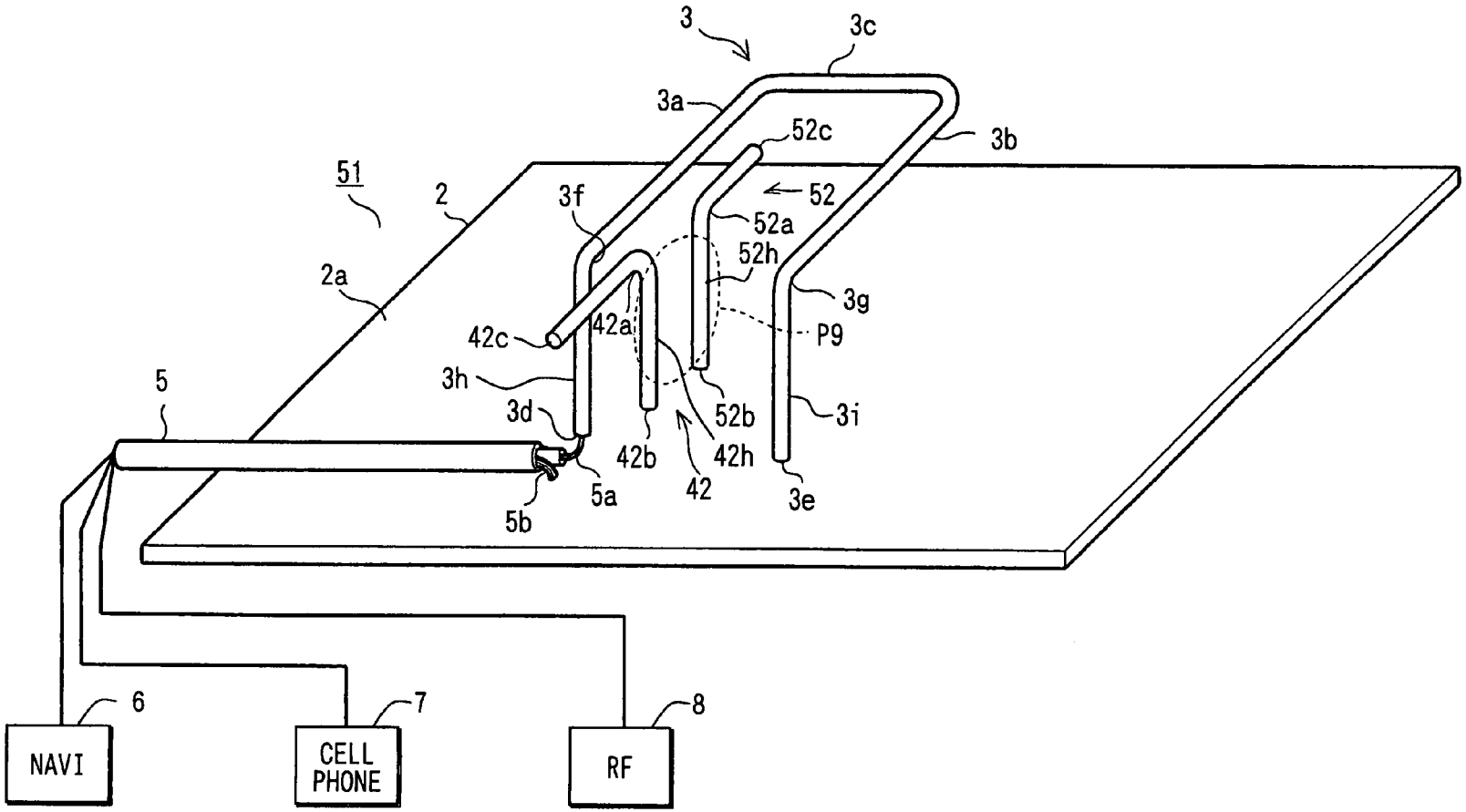
FIG. 8 is a schematic view of an antenna device according to another embodiment of the present invention.

Further, in a structure where a first radiation element is formed of a transmission line antenna and second and third radiation elements are formed of reverse-L shaped antennas, a technology explained in the third embodiment can be adopted. Namely, as shown in FIG. 8, in the antenna 51, a second radiation element 42 is resonant with a first radiation element 3. A leg portion 42*h* of the second radiation element 42 is disposed with a gap in approximately parallel with a leg portion 52*h* of the third radiation element 52, so that electromagnetic coupling is generated therebetween (P9 in FIG. 8). The third radiation element 52 is resonant with the second radiation element 42.

Further, frequency bands dealt by the present invention can be other frequency bands such as "1.5 GHz," instead of "800 MHz," "1.9 GHz," or "2.1 GHz."

Furthermore, not only two-frequency or three-frequency resonance, but also multiple-frequency resonance (more than three frequencies) can be achieved by repeatedly constructing a relationship between a second radiation element and a third radiation element.

It will be obvious to those skilled in the art that various changes may be made in the above-described embodiments of the present invention. However, the scope of the present invention should be determined by the following claims.

What is claimed is:

1. An antenna device comprising:

a ground plane;

a first radiation element; and a second radiation element, wherein the first radiation element is formed of a transmission line antenna including:

a first end portion and a second end portion that are approximately perpendicular to the ground plane, the first end portion that functions as a current feeding point, the second end portion that is electrically connected to the ground plane;

a first bend portion and a second bending portion;

a first side portion and a second side portion that are linked with the first bending portion and the second bending portion, respectively, wherein the first side portion and the second side portion are approximately parallel with the ground plane and approximately parallel with each other; and a first turnup portion that is formed between the first side portion and the second side portion, wherein the second radiation element is formed of a transmission line antenna including:

a first end portion and a second end portion of the second radiation element that are electrically connected to the ground plane and approximately perpendicular to the ground plane;

a first bending portion and a second bending portion of the second radiation element;

a first side portion and a second side portion of the second radiation element that are linked with the first bending portion and the second bending portion of the second radiation element, respectively, wherein the first side portion and the second side portion of the second radiation element are approximately parallel with the ground plane and approximately parallel with each other; and a second turnup portion that is formed between the first side portion and the second side portion of the second radiation element, wherein at least a part of the second radiation element is disposed within the first radiation element, wherein a first portion from the first end portion of the first radiation element to the first bending portion of the first radiation element is disposed with a first gap in approximately parallel with a first portion of the first end portion of the second radiation element to the first bending portion of the second radiation element, and wherein a second portion from the second end portion of the first radiation element is disposed with a second gap in approximately parallel with a second portion from the second end portion of the second radiation element to the second bending portion of the second radiation element.

2. The antenna device of claim 1, wherein a direction of the first side portion of the first radiation element that is defined to be from the first bending portion of the first radiation element towards the turnup portion of the first radiation element, is same as a direction of the first side portion of the second radiation element that is defined to be from the first bending portion of the second radiation element towards the turnup portion of the second radiation element.

3. The antenna device of claim 1, wherein a direction of the first side portion of the first radiation element that is defined to be from the first bending portion of the first radiation element towards the turnup portion of the first radiation element, is opposite to a direction of the first side portion of the second radiation element that is defined to be from the first bending portion of the second radiation element towards the turnup portion of the second radiation element.

4. The antenna device of claim 1, wherein the first gap is approximately same as the second gap.

5. The antenna device of claim 1, wherein the first portion of the first radiation element, the second portion of the first radiation element, the first portion of the second radiation element, and the second portion of the second radiation element have approximately same heights.

6. The antenna device of claim 1, further comprising:

a third radiation element that is formed of a transmission line antenna including:

a first end portion and a second end portion of the third radiation element that are electrically connected to the ground plane and approximately perpendicular to the ground plane;

a first bend portion and a second bending portion of the third radiation element;

a first side portion and a second side portion of the third radiation element that are linked with the first bending portion and the second bending portion of the third radiation element, respectively, wherein the first side portion and the second side portion of the third radiation element are approximately parallel with the ground plane and approximately parallel with each other; and a third turnup portion that is formed between the first side portion and the second side portion of the third radiation element, wherein at least a part of the third radiation element is disposed within the first radiation element, wherein a first portion from the first end portion of the third radiation element to the first bending portion of the third radiation element is disposed with a gap in approximately parallel with a first portion from the first end portion of the second radiation element to the first bending portion of the second radiation element, and wherein a second portion from the second end portion of the third radiation element to the second bending portion of the third radiation element is disposed with a gap in approximately parallel with the second bending portion from the second end portion of the second radiation element to the second bending portion of the second radiation element.

7. The antenna device of claim 1, wherein a current feeding cable that feeds current to the first radiation element is disposed on a same surface of the ground plane where at least the first radiation element and the second radiation element are disposed.

8. The antenna device of claim 7, wherein the current feeding cable is disposed to avoid a space surrounded by the first radiation element and the ground plane and to avoid a space surrounded by the second radiation element and the ground plane.

9. An antenna device comprising:

a ground plane;

a first radiation element; and a second radiation element, wherein the first radiation element is formed of a transmission line antenna including:

a first end portion and a second end portion that are approximately perpendicular to the ground plane, the first end portion that functions as a current feeding point, the second end portion that is electrically connected to the ground plane;

a first bend portion and a second bending portion;

a first side portion and a second side portion that are linked with the first bending portion and the second bending portion, respectively, wherein the first side portion and the second side portion are approximately parallel with the ground plane and approximately parallel with each other; and a turnup portion that is formed between the first side portion and the second side portion, wherein the second radiation element is formed of a reverse-L shaped antenna including:

a first end portion of the second radiation element that is electrically connected to the ground plane;

a second end portion of the second radiation element, and a bending portion of the second radiation element;

wherein at least a part of the second radiation element is disposed within the first radiation element, wherein at least one of a first portion from the first end portion of the first radiation element to the first bending portion of the first radiation element and a second portion from the second end portion of the first radiation element to the second bending portion of the first radiation element is disposed with a gap in approximately parallel with a portion from the first end portion of the second radiation element to the bending portion of the second radiation element.

10. The antenna device of claim 9, wherein a direction of the first side portion of the first radiation element that is defined to be from the first bending portion of the first radiation element towards the turnup portion of the first radiation element is same as a direction that is defined to be from the bending portion of the second radiation element towards the second end portion of the second radiation element.

11. The antenna device of claim 9, wherein a direction of the first side portion of the first radiation element that is defined to be from the first bending portion of the first radiation element towards the turnup portion of the first radiation element is opposite to a direction that is defined to be from the bending portion of the second radiation element towards the second end portion of the second radiation element.

12. The antenna device of claim 9, wherein the first portion of the first radiation element, the second portion of the first radiation element, and the portion of the second radiation element have approximately same heights.

13. The antenna device of claim 9, further comprising:

a third radiation element that is formed of a reverse-L shaped antenna including:

a first end portion of the third radiation element that is electrically connected to the ground plane;

a second end portion of the third radiation element; and a bending portion of the third radiation element;

wherein the portion from the first end portion of the second radiation element to the bending portion of the second radiation element is disposed with a gap in approximately parallel with a portion from the first end portion of the third radiation element to the bending portion of the third radiation element.

14. The antenna device of claim 9, wherein a current feeding cable that feeds current to the first radiation element is disposed on a same surface of the ground plane where at least the first radiation element and the second radiation element are disposed.

15. The antenna device of claim 14, wherein the current feeding cable is disposed to avoid a space surrounded by the first radiation element and the ground plane and to avoid a space surrounded by the second radiation element and the ground plane.

* * * * *